US007342552B2

(12) United States Patent
Harano

(10) Patent No.: US 7,342,552 B2
(45) Date of Patent: Mar. 11, 2008

(54) ANTENNA DEVICE FOR COMPOUND PORTABLE TERMINAL

(75) Inventor: Nobuya Harano, Shizuoka (JP)

(73) Assignee: NEC Corporation, Tokyo (JP)

( * ) Notice: Subject to any disclaimer, the term of this patent is extended or adjusted under 35 U.S.C. 154(b) by 193 days.

(21) Appl. No.: 10/917,512

(22) Filed: Aug. 13, 2004

(65) Prior Publication Data

US 2005/0078039 A1 Apr. 14, 2005

(30) Foreign Application Priority Data

Aug. 14, 2003 (JP) ..... 2003/293440

(51) Int. Cl.
*H01Q 1/38* (2006.01)
*H01Q 19/00* (2006.01)

(52) U.S. Cl. ..... 343/833; 343/700 MS; 343/702

(58) Field of Classification Search ..... 343/700 MS, 343/833, 834, 702
See application file for complete search history.

(56) References Cited

U.S. PATENT DOCUMENTS

| | | | | |
|---|---|---|---|---|
| 5,966,097 | A * | 10/1999 | Fukasawa et al. | 343/700 MS |
| 6,236,368 | B1 | 5/2001 | Johson | 343/702 |
| 6,281,848 | B1 * | 8/2001 | Nagumo et al. | 343/700 MS |
| 6,421,014 | B1 * | 7/2002 | Sanad | 343/700 MS |
| 6,456,249 | B1 * | 9/2002 | Johnson et al. | 343/702 |
| 6,480,155 | B1 * | 11/2002 | Eggleston | 343/700 MS |
| 6,522,300 | B2 | 2/2003 | Oshiyama et al. | |
| 6,639,564 | B2 * | 10/2003 | Johnson | 343/702 |
| 6,980,156 | B2 * | 12/2005 | Komiyama | 343/702 |
| 2001/0005181 | A1 * | 6/2001 | Desclos et al. | 343/817 |
| 2002/0033773 | A1 * | 3/2002 | Hirabayashi | 343/702 |
| 2002/0126050 | A1 | 9/2002 | Oshiyama et al. | 343/702 |
| 2004/0075620 | A1 * | 4/2004 | Tanaka et al. | 345/1.1 |
| 2005/0057401 | A1 * | 3/2005 | Yuanzhu | 343/700 MS |
| 2006/0220959 | A1 * | 10/2006 | Ying | 343/700 MS |

FOREIGN PATENT DOCUMENTS

| | | | |
|---|---|---|---|
| CN | 1254202 | | 5/2000 |
| EP | 0 942 488 | * | 2/1999 |

(Continued)

OTHER PUBLICATIONS

European Search Report dated Nov. 19, 2004.

(Continued)

*Primary Examiner*—Tan Ho
(74) *Attorney, Agent, or Firm*—McGinn IP Law Group, PLLC

(57) ABSTRACT

In a compound portable terminal which supports two communication standards using different frequencies when an antenna is prepared for each communication standard, radio interference occurs in two antennas, and there is a possibility that bit errors increase. To avoid this possibility, there is a problem that two antennas need to be separated from each other as far as possible. To solve this problem, two elements are disposed in the vicinity of each other, a feeding terminal and a ground terminal are disposed in one of the elements, and a ground terminal is disposed in the other element. The other element has no feeding element. When transmission is performed from the feeding terminal, an induced current is produced in the element having no feeding terminal, and each element is excited by individual resonance frequency, and operate as antennas.

20 Claims, 7 Drawing Sheets

FOREIGN PATENT DOCUMENTS

| | | | | |
|---|---|---|---|---|
| EP | 0 942 488 | | * | 9/1999 |
| EP | 0 942 488 | A2 | | 9/1999 |
| EP | 1 003 240 | | * | 5/2000 |
| EP | 1 003 240 | A2 | | 5/2000 |
| EP | 1 102 347 | | * | 5/2001 |
| EP | 1 102 347 | A2 | | 5/2001 |
| EP | 1 328 069 | A2 | | 7/2003 |
| JP | 01-231404 | | | 9/1989 |
| JP | 06-069715 | | | 3/1994 |
| JP | 6-334420 | | | 12/1994 |
| JP | 7-131234 | | | 5/1995 |
| JP | 8-139520 | | | 5/1996 |
| JP | 09-321529 | | | 12/1997 |
| JP | 9-326632 | | | 12/1997 |
| JP | 10-32424 | | | 2/1998 |
| JP | 2803365 | | | 7/1998 |
| JP | 11-177327 | | | 7/1999 |
| JP | 11-340731 | | | 12/1999 |
| JP | 2000-216628 | | | 8/2000 |
| JP | 2000-236216 | | | 8/2000 |
| JP | 2000-278028 | | | 10/2000 |
| JP | 2001-007639 | | | 1/2001 |
| JP | 2001-284936 | | | 10/2001 |
| JP | 2002-217625 | | | 8/2002 |
| JP | 2002-252514 | | | 9/2002 |
| JP | 2002-368850 | | | 12/2002 |
| JP | 2003-078333 | | | 3/2003 |
| JP | 2003-87025 | | | 3/2003 |
| JP | 2003142927 | | * | 5/2003 |

OTHER PUBLICATIONS

European Search Report dated Jan. 26, 2005.

Chinese Office Action dated Aug. 14, 2006 with English Translation.

Chinese Office Action dated Feb. 2, 2007 with English translation.

Japanese Office Action dated Feb. 14, 2006, with partial English translation.

* cited by examiner

ANTENNA DEVICE FOR COMPOUND PORTABLE TERMINAL

This application claims priority to prior Japanese Patent Application JP 2003-293440, the disclosure of which is incorporated herein by reference.

BACKGROUND OF THE INVENTION

The present invention relates to a built-in antenna device for use in a small-sized portable radio such as a cellular phone, which is capable of independently adjusting a plurality of frequencies in order to cope with a plurality of frequency bands.

In Japan, a total number of subscribers of both a cellular phone service and a personal handy phone system (PHS) service exceeds 82 million (as of the end of June, 2003), and the mobile phones are generally carried (or common) items since different frequency bands are provided between the cellular phone service and the PHS service, a mobile phone used for both services must be designed to handle the different frequency bands.

Moreover, there has been a rising demand for speeding up data communication in a field of radio communication as well as that of cable communication. There has also been a demand for enhancement of multi-accessability indicating that many terminals can access one base station, and this is a problem inherent in the radio communication. To meet these demands, second generation systems such as PDC (Personal Digital Communications) and GSM (Global System for mobile Communications) in which a time division multiple access (TDMA) is adopted are shifting to third generation systems such as cdma2000 and W-CDMA in which a code division multiple access (CDMA) is adopted. In the shifting, a different frequency band exclusive for a third generation system is allocated, but a service area thereof has spread at a slow pace because of costs. As a realistic solution of this problem, a compound portable (or mobile) terminal that can be used both in the second and third generations has appeared.

Furthermore, in recent years, in consideration of design, portability and the like, portable terminals have increased in which in-built antennas built in housings of them are adopted rather than antennas protruding to the outside. This tendency can also be seen in the above-described compound portable terminal.

In the compound portable terminal, in addition to a plurality of built-in radios in accordance with the corresponding frequency bands, a plurality of antennas are also required. In the compound portable terminal designed assuming that the terminal is carried by a user, it is difficult to build all the antennas in the terminal.

Additionally, when a plurality of antennas are miniaturized and built in the terminal, interference is frequently caused by resonance among the antennas, and this has been a bottleneck in designing a miniature radio. However, the problem of radio interference has been substantially solved by use of a duplexer.

As an example of a prior technique against these problems, Japanese Patent Application Laid-Open No. 2003-087025 has been proposed. That is, a cellular phone has been disclosed in which a first antenna is disposed through the upper surface of a housing, a second antenna is disposed in lower portion of the housing, which is hard to be covered by an operator's hand, and accordingly two antennas are separated from each other to prevent resonance from being generated.

However, in the prior technique, restrictions on arrangement of the antennas are involved, and there has been a problem in designing a circuit of the cellular phone. Especially, the second antenna disposed in the lower portion of the housing is required to reduce influences caused by covering with the hand. Therefore, further restrictions are imposed on a circuit arrangement.

SUMMARY OF THE INVENTION

To solve the above-described problems, an object of the present invention is to provide an antenna device having a plurality of antenna elements arranged in the vicinity of one another in the same plane.

According to the present invention, there is provided an antenna device comprising a driven element including a feeding terminal and a ground terminal. A parasitic element includes a ground terminal and no feeding terminal. The driven element produces a magnetic field by feeding from the feeding terminal, and the parasitic element produces an induced current by the magnetic field.

Furthermore, the driven element is disposed in parallel with the parasitic element.

Moreover, the driven element is excited by a natural resonance frequency of the driven element during the feeding.

Additionally, the parasitic element is excited by a natural resonance frequency of the parasitic element during the production of the induced current.

Moreover, the feeding terminal and the ground terminal of the driven element and the ground terminal of the parasitic element are spring terminals.

Furthermore, the feeding terminal and the ground terminal of the driven element and the ground terminal of the parasitic element are spring connectors.

Additionally, the driven element is integrated with the parasitic element.

Moreover, the driven element is integrated with the parasitic element by means of a resin.

There is provided a cellular phone comprising an antenna device comprising a driven element including a feeding terminal and a ground terminal. A parasitic element includes a ground terminal and no feeding terminal. The driven element produces a magnetic field by feeding thorough the feeding terminal, and the parasitic element produces an induced current therein by the magnetic field.

In the cellular phone, the driven element and the parasitic element are rectangular, and the driven element is disposed in parallel with the parasitic element.

In addition, the antenna device is fixed to a rear case of the cellular phone.

Moreover, the antenna device is fixed to the rear case by a double-faced adhesive tape.

Furthermore, the cellular phone further comprises a substrate. The antenna device is fixed to the substrate.

Furthermore, the feeding terminal and the ground terminal of the driven element and the ground terminal of the parasitic element are spring terminals. The antenna device is fixed to the substrate by the spring terminals.

Additionally, the feeding terminal and the ground terminal of the driven element and the ground terminal of the parasitic element are spring connectors. The antenna device is fixed to the substrate by the spring connectors.

Furthermore, the above-described cellular phone further comprises a cushion. The cushion is disposed between the antenna device and the substrate except the feeding terminal and the ground terminals.

Additionally, the antenna device is pressed and fixed onto the rear case of the cellular phone by the cushion.

In the present invention, two antenna elements are disposed in an upper portion of a housing of a cellular phone. The upper portion is hard to be influenced by operator's hands. When feeding is made to one of the antenna elements, an induced power is induced in the other antenna element. The antenna elements are excited by natural resonance frequencies, respectively, and are operated as antennas. Moreover, the above-described constitution is not influenced by the operator's hands, and, as a result, the constitution is useful in raising an antenna gain.

Furthermore, since both the antenna elements disposed in the vicinity of each other, a degree of freedom in a circuit constitution increases.

DESCRIPTION OF THE PREFERRED EMBODIMENTS

The present invention will be described hereinafter in detail in accordance with embodiments.

First Embodiment

Figure 1:
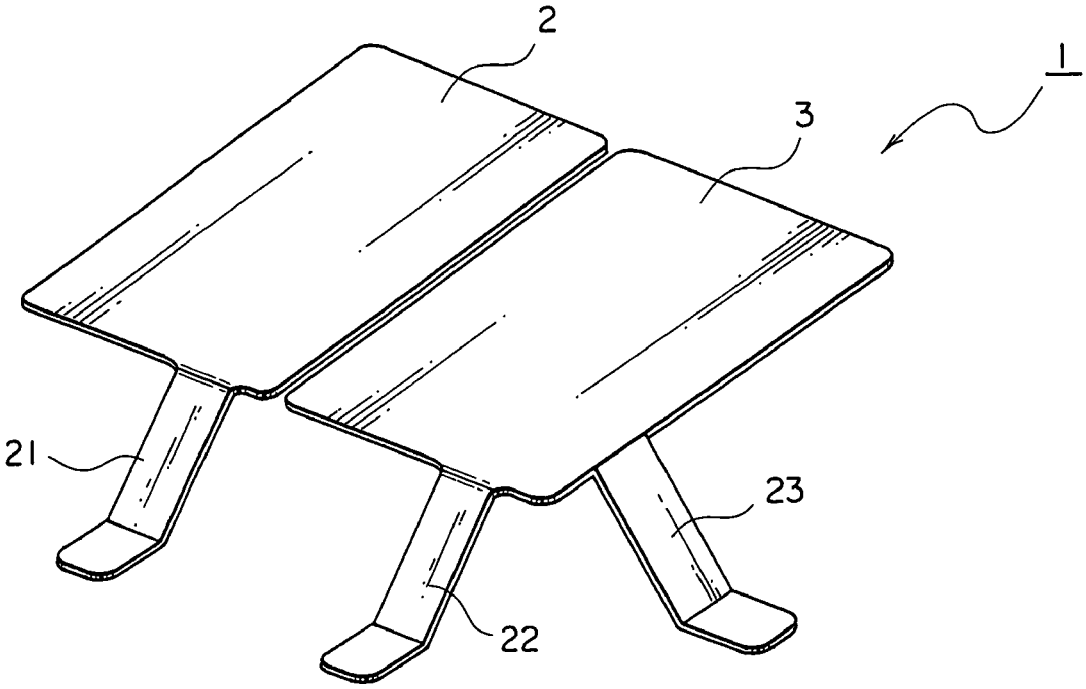
FIG. 1 is a perspective view of an antenna element for use in an antenna device according to a first embodiment of the present invention.
Figure 2:
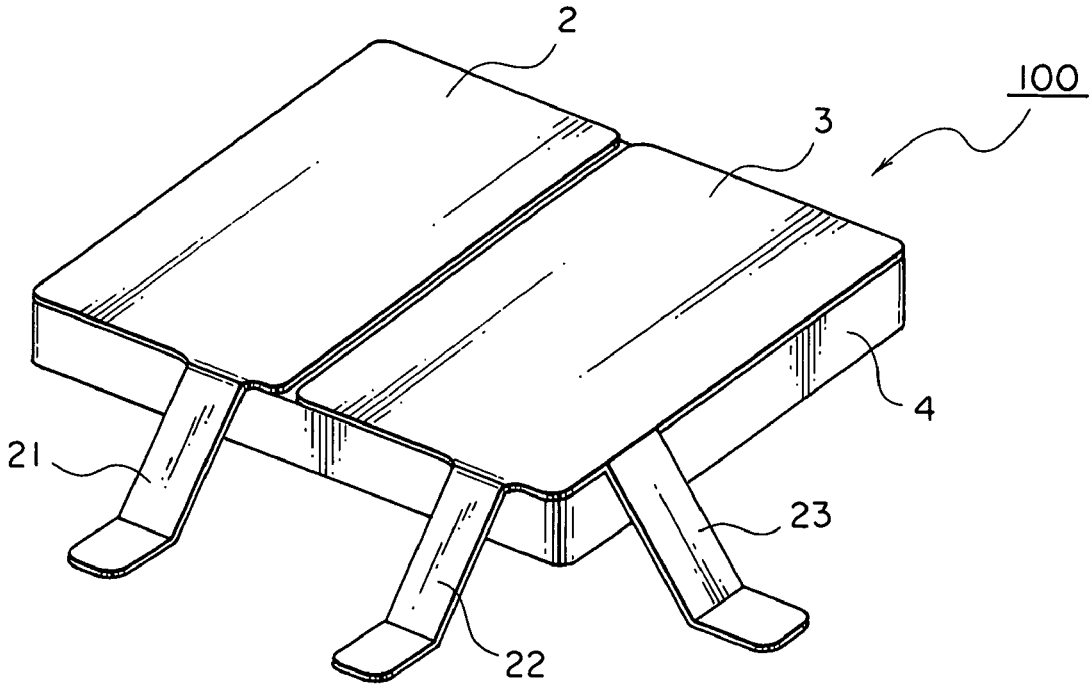
FIG. 2 is a perspective view of the antenna device according to the first embodiment of the present invention.
Figure 3:
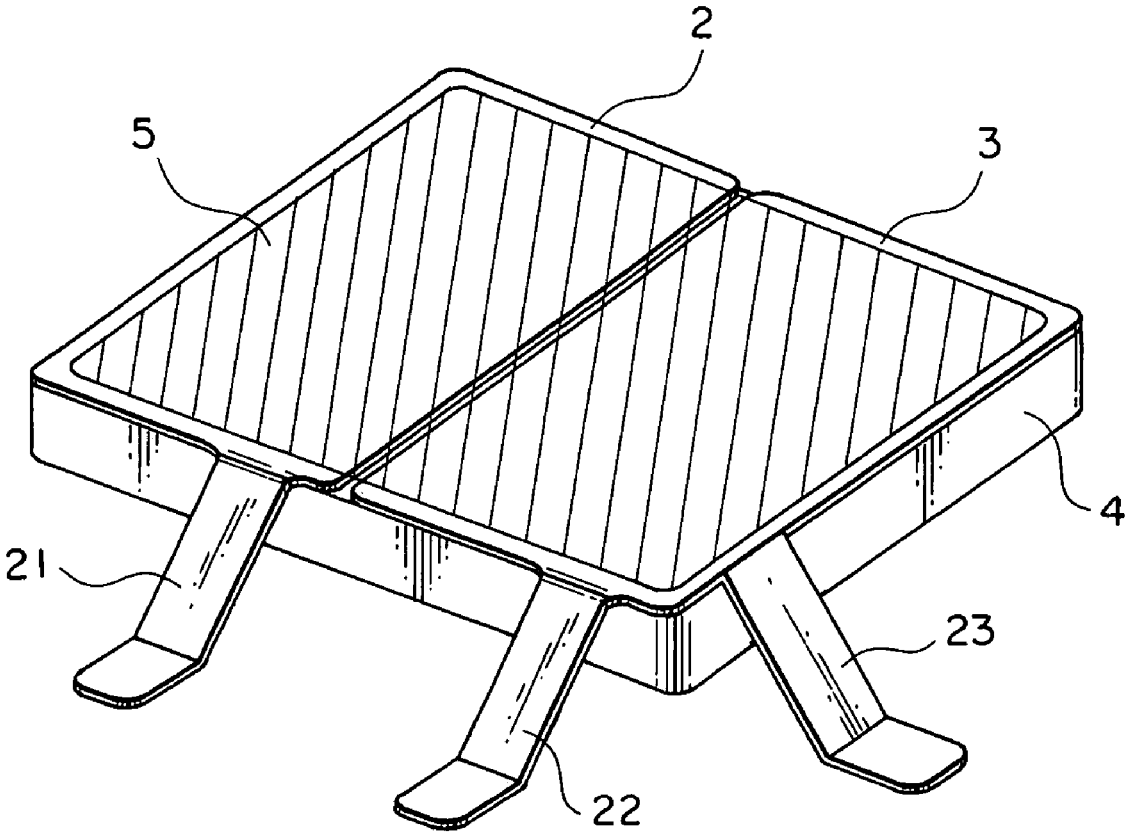
FIG. 3 is a perspective view in a case where a double-faced adhesive tape is attached to the antenna device of FIG. 2.
Figure 4:
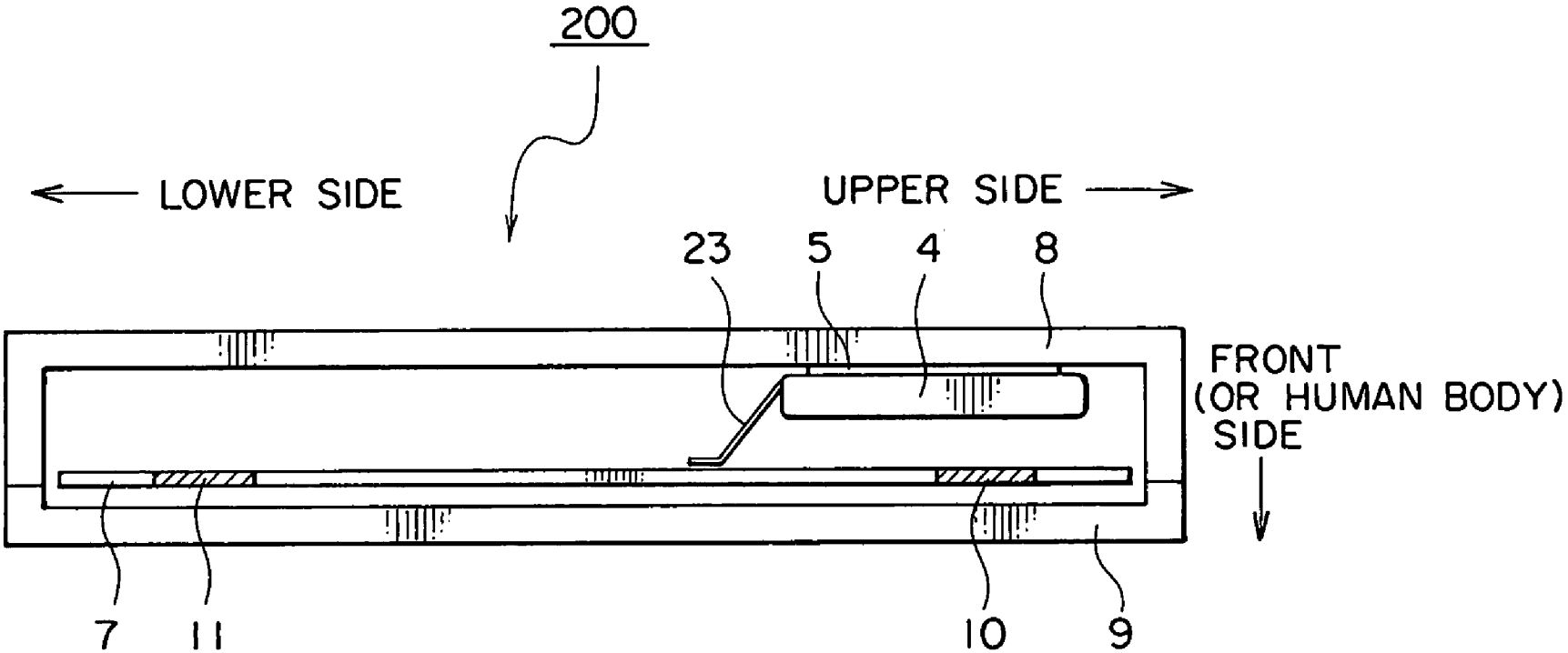
FIG. 4 is a sectional view of a cellular phone using the antenna device of FIG. 2.
Figure 5:
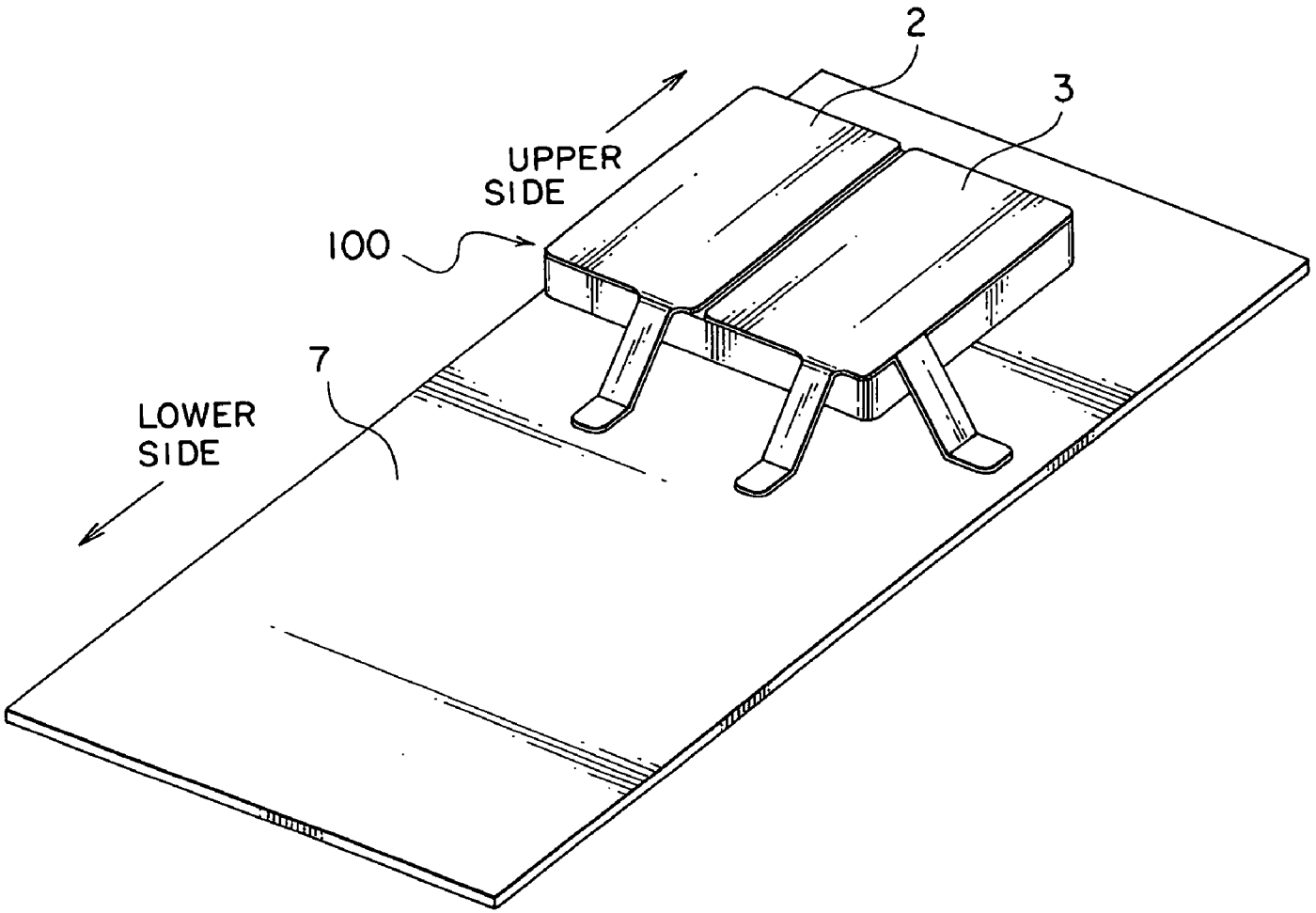
FIG. 5 is a perspective view in a case where the antenna device of FIG. 2 is attached to a substrate.

FIG. 1 is a perspective view of an antenna element 1 of an antenna device (100 of FIG. 2) according to a first embodiment of the present invention. FIG. 2 is a perspective view showing a constitution of the antenna device 100 constituted of the antenna element 1 of FIG. 1. FIG. 3 is a perspective view of the antenna device 100 of FIG. 2 to whose rear surface (an upper side in FIG. 2) a double-faced adhesive tape 5 is attached and which is fixable into a cellular phone (200 of FIG. 4). FIG. 4 is a sectional view of the cellular phone 200 after the antenna device 100 is disposed. FIG. 5 is a perspective view schematically showing a positional relation between a substrate 7 and the antenna device 100 in a case where the antenna device 100 of FIG. 2 is disposed on the substrate 7.

As illustrated in FIG. 1, the antenna element 1 of the present invention includes a parasitic antenna element 2 and a driven antenna element 3. The parasitic element 2 has a main rectangular plate and a ground spring terminal 21 diagonally extending ahead (downward in FIGS. 1 to 5) from the main rectangular plate. The parasitic element 2 does not have a feeding terminal. On the other hand, the driven element 3 has a main rectangular plate and a ground spring terminal 22 and a feeding spring terminal 23. The terminals 22 and 23 diagonally extend ahead (downward in FIGS. 1 to 5) from the main rectangular plate of the driven element 3. The main plates of the parasitic antenna element 2 and the driven element 3 are disposed in the vicinity of each other. Particularly, the main plates of the element 2 and 3 are located in parallel to each other in the name plane.

As shown in FIG. 5, the parasitic element 2 is connected onto the substrate 7 by the ground spring terminal 21. The driven element 3 is also connected onto the substrate 7 by the ground spring terminal 22 and the feeding spring terminal 23.

The ground spring terminals 21 and 22 are connected to a ground pattern (not shown) of the substrate 7, and grounded. The feeding spring terminal 23 is connected to a feeding pattern (not shown) of the substrate 7, and is connected to a radio circuit (not shown). It is to be noted that in the present embodiment, each terminal is a spring terminal, but does not have to be the spring terminal. This is because any spring is not required, when the device is fixed to a rear case 8 by the double-faced tape 5 as illustrated in FIG. 4.

The antenna device 100 of the present invention is constituted of the antenna element 1, a resin 4, and additionally the double-faced adhesive tape 5 as illustrated in FIG. 3.

Moreover, the cellular phone 200 is constituted of the antenna device 100, the substrate 7, additionally the rear case 8, and a front case 9 as illustrated in FIG. 4.

The substrate 7 is provided with a receiving section 10 and a transmitting section 11. Additionally, the receiving section 10 and the transmitting section 11 are omitted from FIG. 5.

In FIG. 2, the resin 4 is charged into a lower part of the antenna element 1, under the parasitic element 2 and the driven element 3, and accordingly the parasitic element 2 is fixed to the driven element 3. On the other words, the resin 4 integrates the parasitic element 2 with the driven element 3. The resin 4 keeps a fixed interval between the parasitic element 2 and the driven element 3. In the present invention, feeding is executed to the driven element 3 via the feeding spring terminal 23. The feeding causes an electric field around the driven element 3 and the electric field causes an induced current in the parasitic element 2. When the feeding has a first frequency equal to a natural resonance frequency of the driven element 3, the driven element 3 is excited by the natural resonance frequency thereof during the feeding. On the other hand, when the feeding has a second frequency equal to a natural resonance frequency of the parasitic element 2, the parasitic element 2 is excited by the natural resonance frequency thereof during the feeding. IF the first and the second frequencies are different from each other, both the antenna elements function as the different antennas for two frequency bands.

Meanwhile, when the interval between the parasitic element 2 and the driven element 3 changes in accordance with a direction and/or a state of the antenna device 100, a constant induced current cannot be produced. Therefore, the resin 4 fixes the interval.

When the antenna device 100 is mounted on the substrate 7 in the constitution of FIG. 2 as such, a total weight of the antenna device 100 is held by the ground spring terminals 21 and 22 and the feeding spring terminal 23, and the device lacks a physical stability. As a measure, as shown in FIG. 3, when the double-faced adhesive tape 5 is attached to the upper surface of the antenna device 100 to fix the device to the rear case 8, an excessive stress can be prevented from being applied to the above-described group of terminals 21-23. A component (receiving section 10 in the present embodiment) can be effectively mounted also on a portion of the substrate 7 in front of the antenna device 100 (under the antenna device 100 in FIG. 4). It is to be noted that the present embodiment does not deny that the device is held by the spring terminals 21, 22 and 23 as long as a sufficient strength can be held.

FIG. 4 is the sectional view of the cellular phone 200 to which the antenna device 100 is fixed by the double-faced adhesive tape 5. The antenna device 100 is connected to the rear case 8 by the double-faced adhesive tape 5. It is seen that any excessive stress is not applied to the terminals 21-23 and that a space for mounting a component can be secured also under the antenna device 100.

FIG. 5 is the perspective view schematically showing a positional relation on the substrate 7 in a case where the antenna device 100 is disposed on the substrate 7 of the cellular phone 200 of FIG. 4. It is seen that the antenna device 100 is disposed in an upper portion of the cellular phone 200, when the substrate 7 is disposed in the cellular phone 200. Here, the upper portion is one of end portions in the longitudinal direction. Assuming a usual use method, the receiving section is disposed in the upper portion, and the transmitting section is disposed in an lower portion, but the present invention is not necessarily limited to this constitution.

It is to be noted that a problem of radio interference between the parasitic element 2 and the driven element 3 remains unsolved, but the interference can be suppressed using a duplexer (not shown).

Furthermore, adjustment of the natural resonance frequency of the parasitic element 2 can be modified by change of the shape and adjustment of a gap between the element and the substrate. Similarly, the natural resonance frequency of the driven element 3 can be modified by change of the shape and adjustment of a gap between the element and the substrate. Thus, the parasitic element 2 and the driven element 3 can be individually modified with respect to their natural resonance frequencies.

Second Embodiment

A second embodiment of the present invention will be described hereinafter with reference to FIGS. 6 and 7.

Figure 6:
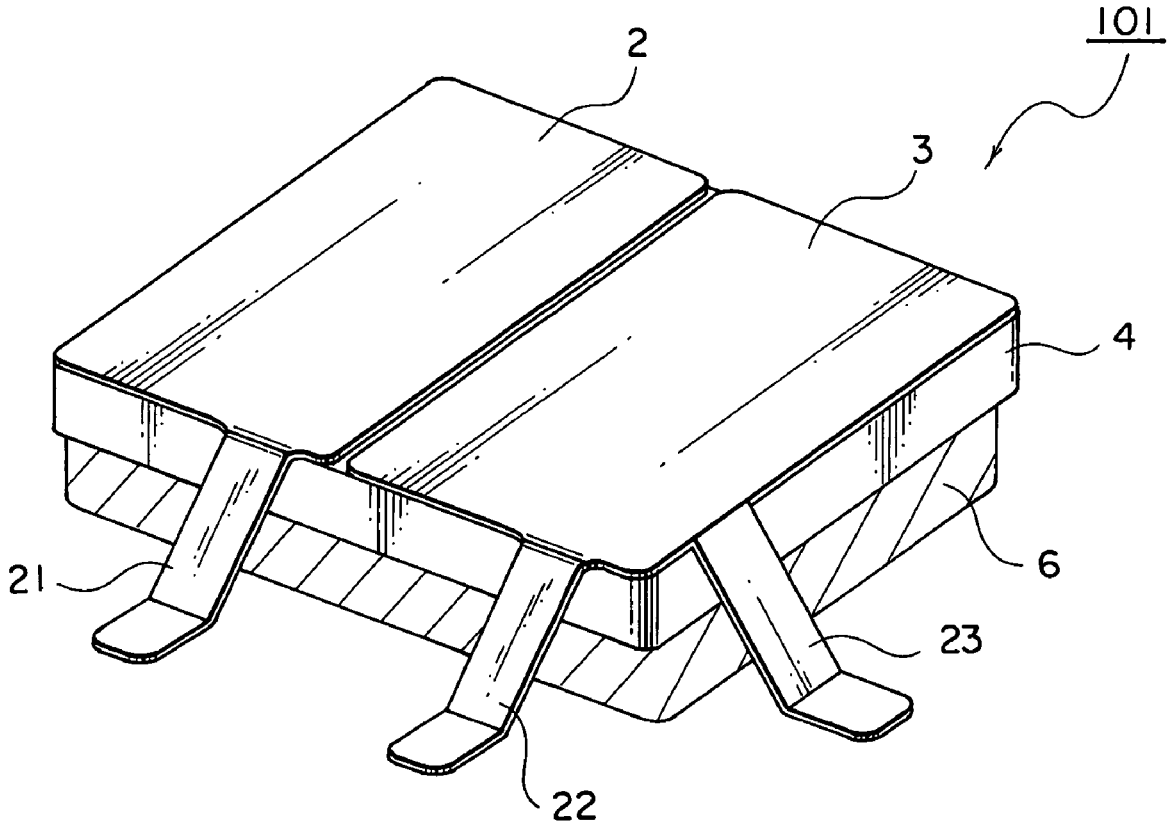
FIG. 6 is a perspective view of an antenna device with a cushion according to a second embodiment of the present invention.

FIG. 6 is a perspective view of an antenna device 101 according to a second embodiment of the present invention. FIG. 7 is a sectional view of a cellular phone 201 using the antenna device 101.

FIG. 6 is the perspective view of the antenna device 101. The device is different from the antenna device 100 of the first embodiment in that a cushion 6 is disposed instead of the double-faced adhesive tape 5. Accordingly, the antenna device 101 is not fixed to the rear cover 8 but to a substrate 7. The second embodiment is inferior to the first embodiment in a mountable area of the substrate 7, but is superior to the first embodiment in ease of assembling. This is because the substrate 7 can be incorporated in the rear cover 8 while confirming that the antenna device 101 is fixed to the substrate 7. To increase the mountable area of the substrate 7, the cushion 6 may be hollowed (or shaped into a frame). Alternatively, the cushion 6 may be constituted of a group of small cushions, and the substrate 7 and a resin 4 may be fixed to each cushion.

Figure 7:
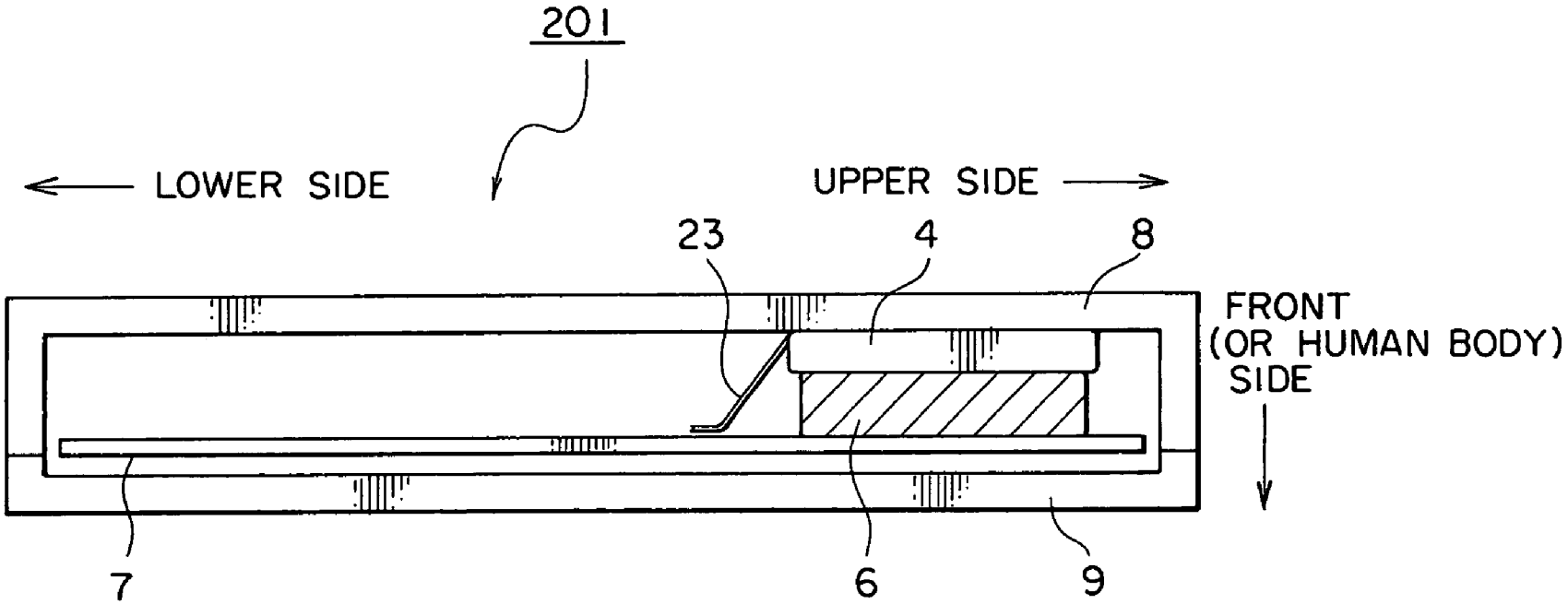
FIG. 7 is a sectional view of a cellular phone using the antenna device of FIG. 6.

FIG. 7 is the sectional view of the cellular phone 201 using the antenna device 101. The cushion 6 is disposed between the resin 4 (or the elements 2 and 3) and the substrate 7. The antenna device 101 is pressed onto an inner wall surface of the rear cover 8 by the cushion 6.

It is to be noted that the device does not have to be necessarily pressed onto the inner wall surface of the rear cover 8 as long as a certain distance can be secured between the substrate 7 and the pair of the parasitic element 2 and driven element 3 of the antenna device 101 by the cushion 6. This is because an effect similar to an effect obtained by pressing the device onto the inner wall surface is obtained by spring stresses of the ground spring terminals 21 and 22 and the feeding spring terminal 23, and a reaction force of the cushion 6.

Third Embodiment

A third embodiment of the present invention will be described hereinafter with reference to FIG. 8.

Figure 8:
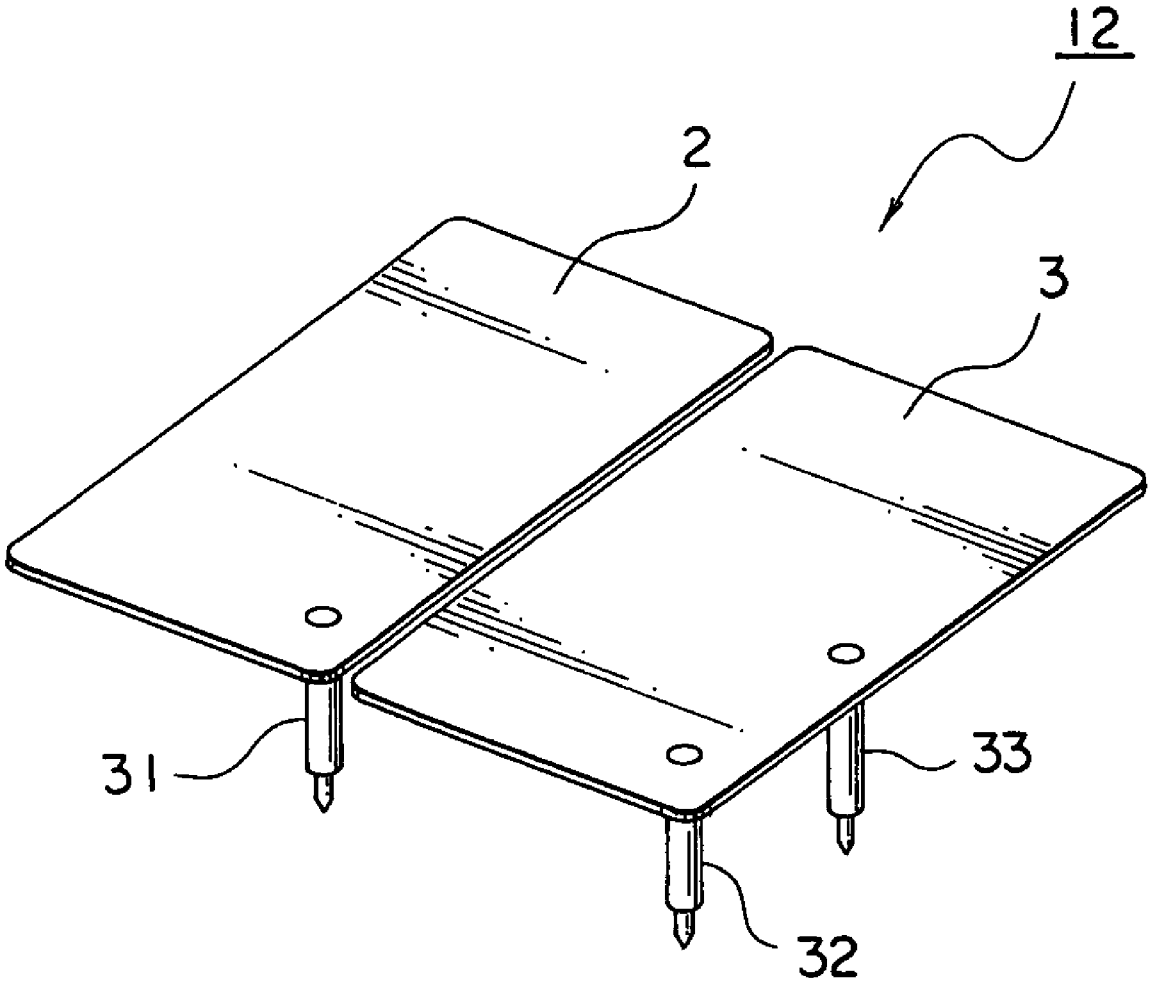
FIG. 8 is a perspective view of an antenna element according to a third embodiment of the present invention

FIG. 8 is a perspective view showing a constitution of an antenna element 12. The present embodiment is different from the embodiment of FIG. 1 in that the element is connected to the substrate 7 via spring connectors.

The parasitic element 2 is connected to the substrate 7 by a ground spring connector 31. It is to be noted that if there is a fear as to the element fixed by one point, one or more non-conductive spring connectors may be used to mechanically connect the element 2 to the substrate 7.

The driven element 3 is fixed to the substrate 7 by a ground spring connector 32 and a feeding spring connector 33. One or more non-conductive spring connectors may be used to mechanically connect the element 3 to the substrate 7.

When the spring connectors 31-33 are used, a design for reducing, to the utmost, or eliminating contact of the element with an inner wall surface of a rear cover 8 becomes possible.

While this invention has thus far been described in conjunction with the preferred embodiments thereof, it will readily be possible for those skilled in the art to put this invention into practice in various other manners. For example, the cushion 6 instead of the resin 4 may be used for integration of the parasitic element 2 and driven element 3.

What is claimed is:

1. An antenna device comprising:

a resin member having an upper surface and a lower surface;

a driven element formed on said upper surface of said resin member comprising a longitudinal axis and including a feeding terminal and a ground terminal which extends in a direction away from said upper surface and below said lower surface; and a parasitic element formed on said upper surface of said resin member comprising a longitudinal axis and including a ground terminal which extends in a direction away from said upper surface and below said lower surface and no feeding terminal, wherein said driven element and said parasitic element are disposed a uniform distance from each other, wherein said longitudinal axes of the driven element and the parasitic element are disposed parallel to each other, wherein the driven element produces a magnetic field by feeding through the feeding terminal, and the parasitic element produces an induced current therein by the magnetic field.

2. The antenna device according to claim 1, wherein the driven element is disposed in parallel with the parasitic element.

3. The antenna device according to claim 1, wherein the driven element is excited with a natural resonance frequency of the driven element during the feeding.

4. The antenna device according to claim 1, wherein the parasitic element is excited with a natural resonance frequency of the parasitic element during the production of the induced current.

5. The antenna device according to claim 1, wherein the feeding terminal and the ground terminal of the driven element and the ground terminal of the parasitic element comprise spring terminals.

6. The antenna device according to claim 1, wherein the feeding terminal and the ground terminal of the driven element and the ground terminal of the parasitic element comprise connectors oriented in a direction orthogonal to the driven and parasitic elements and connected inside of the peripheral edges of the driven and parasitic elements.

7. The antenna device according to claim 1, wherein the driven element is integrated with the parasitic element.

8. The antenna device according to claim 1, wherein distal ends of said feeding terminal and said ground terminals extend below a surface of said resin opposite said driven and parasitic elements.

9. A cellular phone comprising:

an antenna device comprising:

a resin member having an upper surface and a lower surface;

a driven element formed on said upper surface of said resin member comprising a longitudinal axis and including a feeding terminal and a ground terminal which extends in a direction away from said upper surface and below said lower surface; and a parasitic element formed on said upper surface of said resin member comprising a longitudinal axis and including a ground terminal which extends in a direction away from said upper surface and below said lower surface and no feeding terminal, wherein said driven element and said parasitic element are disposed a uniform distance from each other, wherein said longitudinal axes of the driven element and the parasitic element are disposed parallel to each other, wherein the driven element produces a magnetic field by feeding through the feeding terminal, and the parasitic element produces an induced current therein by the magnetic field.

10. The cellular phone according to claim 9, wherein the driven element is disposed in parallel with the parasitic element.

11. The cellular phone according to claim 9, wherein the antenna device is fixed to a rear case of the cellular phone.

12. The cellular phone according to claim 11, wherein the antenna device is fixed to the rear case by a double-faced adhesive tape.

13. A cellular phone according to claim 9, further comprising a substrate, wherein the antenna device is fixed to the substrate.

14. The cellular phone according to claim 13, wherein the feeding terminal and the ground terminal of the driven element and the ground terminal of the parasitic element comprise spring terminals, and the antenna device is fixed by the spring terminal to the substrate.

15. The cellular phone according to claim 13, wherein the feeding terminal and the ground terminal of the driven element and the ground terminal of the parasitic element comprise connectors oriented in a direction orthogonal to the driven and parasitic elements and connected inside of the peripheral edges of the driven and parasitic elements, and the antenna device is fixed by the connectors to the substrate.

16. The cellular phone according to claim 13, further comprising a cushion, wherein the cushion is disposed between the antenna device and the substrate.

17. The cellular phone according to claim 16, wherein the antenna device is pressed and fixed onto a rear case of the cellular phone.

18. The cellular phone according to claim 9, wherein the antenna device is fixed to an upper potion of a housing of the cellular phone.

19. An antenna device comprising:

a resin member having an upper surface and a lower surface;

a driven element formed on said upper surface of said resin member comprising a longitudinal axis and including an integrally formed feeding terminal and a ground terminal which extends in a direction away from said upper surface and below said lower surface; and a parasitic element formed on said upper surface of said resin member comprising a longitudinal axis and including a ground terminal which extends in a direction away from said upper surface and below said lower surface and no feeding terminal, wherein said driven element and said parasitic element are disposed parallel to and a uniform distance from each other, wherein said longitudinal axes of the driven element and the parasitic element are disposed parallel to each other, wherein the driven element produces a magnetic field by feeding through the feeding terminal, and the parasitic element produces an induced current therein by the magnetic field.

20. The antenna device of claim 19, wherein said uniform distance is disposed between a side portion of said driven element and an adjacent side portion of said parasitic element and said driven and parasitic elements are disposed in a common plane.

* * * * *